US008126346B2

(12) United States Patent
Yura et al.

(10) Patent No.: US 8,126,346 B2
(45) **Date of Patent: *Feb. 28, 2012**

(54) APPARATUS AND METHOD FOR FIXING AN IMAGE

(75) Inventors: Jun Yura, Kanagawa (JP); Koichi Kato, Kanagawa (JP); Hiroshi Nakai, Kanagawa (JP); Kazumi Suzuki, Kanagawa (JP); Kei Yasutomi, Kanagawa (JP); Hideki Kosugi, Kanagawa (JP); Hirokatsu Suzuki, Chiba (JP); Ichiro Kadota, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/570,746

(22) Filed: Sep. 30, 2009

(65) Prior Publication Data

US 2010/0021195 A1 Jan. 28, 2010

Related U.S. Application Data

(62) Division of application No. 11/128,363, filed on May 13, 2005, now Pat. No. 7,620,336.

(30) Foreign Application Priority Data

May 13, 2004 (JP) ..... 2004-142992

(51) Int. Cl.
*G03G 15/20* (2006.01)

(52) U.S. Cl. ..... 399/67; 399/69; 399/70

(58) Field of Classification Search ..... 399/67, 399/69, 70

See application file for complete search history.

(56) References Cited

U.S. PATENT DOCUMENTS

| | | | | |
|---|---|---|---|---|
| 4,232,959 | A | 11/1980 | Ateya et al. | |
| 5,099,289 | A | 3/1992 | Kurotori et al. | |
| 5,247,336 | A | 9/1993 | Mills, III | |
| 5,708,926 | A | 1/1998 | Sagara et al. | |
| 6,078,781 | A * | 6/2000 | Takagi et al. | 399/330 |
| 6,173,136 | B1 | 1/2001 | Fuchiwaki et al. | |
| 6,308,021 | B1 | 10/2001 | Isogai et al. | |
| 6,346,800 | B1 | 2/2002 | Mano et al. | |
| 6,347,201 | B1 | 2/2002 | Sano et al. | |
| 6,678,498 | B2 * | 1/2004 | Terada et al. | 399/328 |
| 7,010,255 | B2 | 3/2006 | Yura et al. | |
| 7,043,167 | B2 | 5/2006 | Ichikawa et al. | |
| 7,049,562 | B2 | 5/2006 | Tanino et al. | |

(Continued)

FOREIGN PATENT DOCUMENTS

JP 57129476 A * 8/1982

(Continued)

OTHER PUBLICATIONS

JP 57129476 A to Aoki et al., English Abstract.*

(Continued)

*Primary Examiner* — Ryan Walsh

(74) *Attorney, Agent, or Firm* — Oblon, Spivak, McClelland, Maier & Neustadt, L.L.P.

(57) ABSTRACT

An apparatus and method for image fixing are disclosed. A fixing device includes a fixing member, a pressure member, a heater, and a pressure controller. The fixing member and the pressure member face with each other to form a nip. The heater heats a surface of the fixing member when the fixing member rotates. The pressure controller changes a pressure generated at the nip, according to an operation of the fixing device.

10 Claims, 9 Drawing Sheets

U.S. PATENT DOCUMENTS

| | | | | |
|---|---|---|---|---|
| 2002/0031361 | A1 | 3/2002 | Shiiya | |
| 2002/0176724 | A1 | 11/2002 | Fuma et al. | |
| 2003/0081970 | A1 | 5/2003 | Yamamoto et al. | |
| 2003/0147680 | A1 | 8/2003 | Kawamura et al. | |
| 2003/0161651 | A1* | 8/2003 | Tatematsu et al. | 399/69 |
| 2003/0180075 | A1 | 9/2003 | Hayami et al. | |
| 2004/0001731 | A1 | 1/2004 | Kim et al. | |
| 2004/0156660 | A1 | 8/2004 | Fuma et al. | |
| 2004/0202491 | A1 | 10/2004 | Sakai et al. | |

FOREIGN PATENT DOCUMENTS

| | | |
|---|---|---|
| JP | 08-129313 | 5/1996 |
| JP | 10-293497 | 11/1998 |
| JP | 10-307496 | 11/1998 |
| JP | 11-065352 | 3/1999 |
| JP | 11-202652 | 7/1999 |
| JP | 2001-242732 | 9/2001 |
| JP | 2001-282041 | 10/2001 |
| JP | 2001-312168 | 11/2001 |
| JP | 2002-311745 | 10/2002 |
| JP | 2002-351249 | 12/2002 |
| JP | 2003-91203 | 3/2003 |
| JP | 2003-345173 | 12/2003 |
| JP | 2004-094266 | 3/2004 |

OTHER PUBLICATIONS

JP 57129476 A to Aoki et al. Aug. 1982 , English Abstract.*

Office Action issued Nov. 9, 2010, in Japanese Patent Application No. 2004-142992, filed May 13, 2004.

Japanese Office Action issued May 31, 2011, in Patent Application No. 2004-142992.

* cited by examiner

APPARATUS AND METHOD FOR FIXING AN IMAGE

CROSS-REFERENCE TO RELATED APPLICATIONS

This application is a divisional of U.S. application Ser. No. 11/128,363 filed May 13, 2005 now U.S. Pat. No. 7,620,336, the entire contents of which are incorporated herein by reference. U.S. application Ser. No. 11/128,363 is based on and claims priority to Japanese patent application No. 2004-142992, filed on May 13, 2004, the entire contents of which are hereby incorporated herein by reference.

FIELD

The following disclosure relates generally to an apparatus and method for fixing an image.

BACKGROUND

An image forming apparatus is usually provided with a fixing device for fixing a toner image on a recording medium by heat and pressure. For example, a fixing roller having a heater inside and a pressure roller are provided to form a nip. When a recording medium passes through the nip, a toner image is heated by the heater through the fixing roller, and fixed onto the recoding medium by a pressure generated at the nip.

Recently, to reduce a warm-up time, a fixing roller having a low heat capacitance is provided with an external heater. The external heater heats up the surface of the fixing roller, which constantly rotates, at a position away from the nip.

However, the heat applied to the fixing roller may be transmitted to the other member, such as the pressure roller in contact with the fixing roller, thus causing a large amount of energy loss.

Further, the rotation of the fixing roller may accelerate wear of the surface of the fixing roller, or it may increase the amount of electric consumption.

SUMMARY

Exemplary embodiments of the present invention include a fixing device for use in an image forming apparatus.

In an exemplary embodiment, the fixing device includes a fixing member, a pressure member, a heater, and a pressure controller. The fixing member and the pressure member face with each other to form a nip. The heater heats a surface of the fixing member when the fixing member rotates. The pressure controller changes a pressure generated at the nip, according to an operation of the image fixing device.

In an exemplary embodiment, the fixing device includes a controller, a fixing member, a pressure member, a heater, and a pressure controller.

The controller switches operation modes of the fixing device, including a waiting mode and an operating mode. The fixing member rotates in the operating mode. The pressure member, facing the fixing member, forms a nip with the fixing member. The heater heats a surface of the fixing member in the operating mode. The pressure controller changes a pressure generated at the nip when the operation modes are switched.

In addition to the above-described fixing devices, this patent specification may be implemented in many other ways, as will be apparent to those skilled in the art, without departing from the spirit or scope of the appended claims and the following disclosure.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
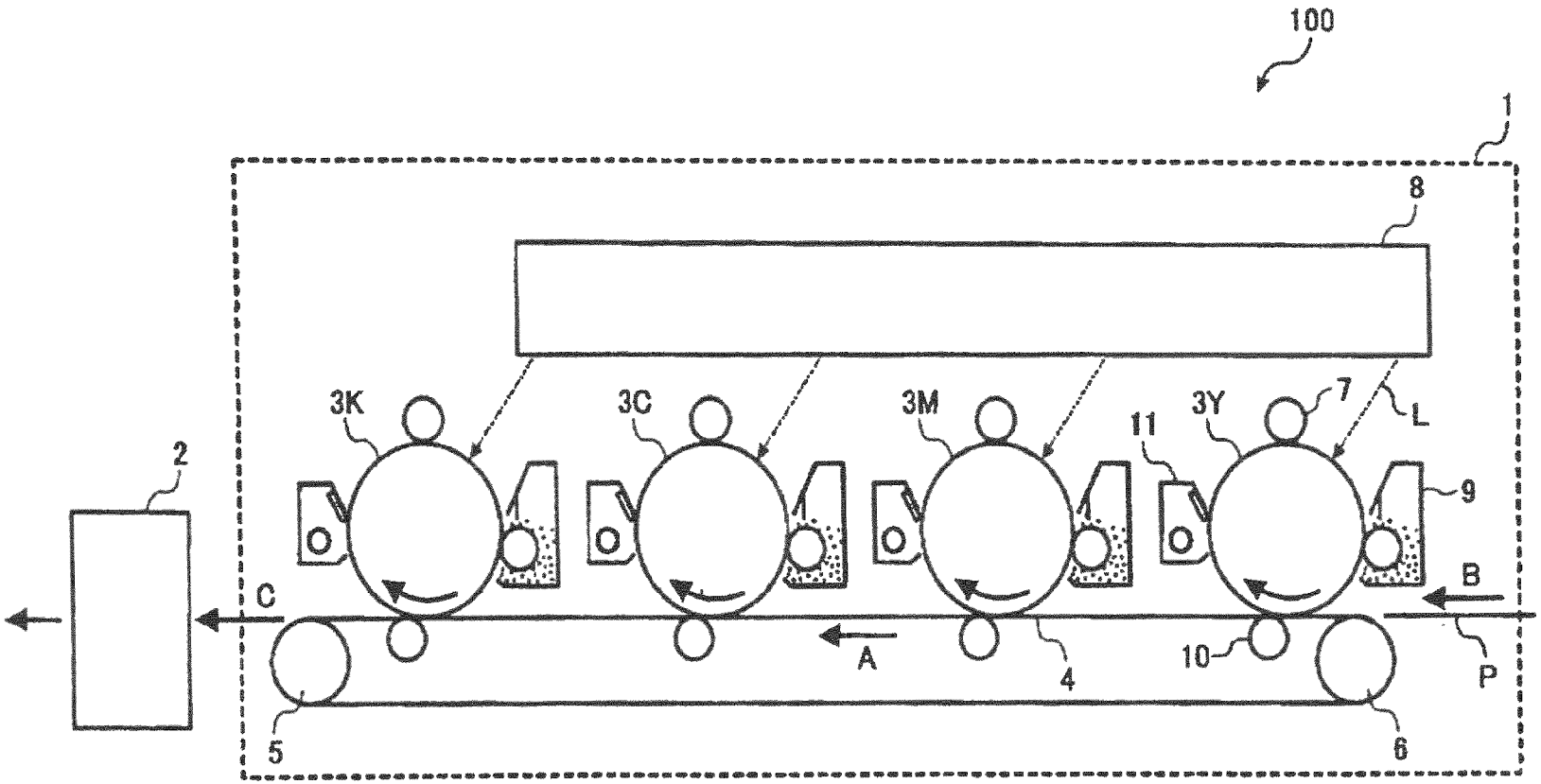
FIG. 1 is a schematic side view illustrating a part of an image forming apparatus according to an exemplary embodiment of the present invention.

In describing preferred embodiments illustrated in the drawings, specific terminology is employed for clarity. However, the disclosure of this patent specification is not intended to be limited to the specific terminology selected and it is to be understood that each specific element includes all equivalents that operate in a similar manner. Referring now to the drawings, wherein like reference numerals designate identical or corresponding parts throughout the several views, FIG. 1 illustrates an image forming apparatus 100 according to an exemplary embodiment of the present invention.

In FIG. 1, a selected portion of the image forming apparatus 100, including an image forming device 1 and a fixing device 2, is shown.

The image forming device 1 forms a toner image on a recording medium. The image forming device 1 includes a writing unit 1, first to fourth image carriers 3Y, 3M, 3C, and 3K, an intermediate transfer belt 4, a first roller 5, and a second roller 6.

The first to fourth image carriers 3Y to 3K are arranged side by side. The intermediate transfer belt 4 is provided in parallel to the first to fourth image carriers 3Y to 3K. The first roller 5 and the second roller 6 drive the intermediate transfer belt 4 in the direction indicated by the arrow A.

Each of the first to fourth image carriers 3Y to 3K forms a toner image in a substantially similar manner. As a way of example, an image forming operation for forming a yellow toner image is explained.

The first image carrier 3Y, which rotates clockwise, is uniformly charged by a charging roller 7. The writing unit 8 irradiates a modulated laser beam L onto the charged surface of the first image carrier 3Y. This forms a latent image on the first image carrier 3Y. The latent image is developed by a developer 9 into a yellow toner image.

The intermediate transfer belt 4 receives a recording medium, such as paper P, which is transferred in the direction indicated by the arrow B. The paper P is further carried by the intermediate transfer belt 4 in the direction A. When the paper passes through a nip formed between the first image carrier 3Y and a transfer roller 10, which faces the first image carrier 3Y, a voltage having the polarity opposite to the charged polarity is applied. As a result, the yellow toner image formed on the first image carrier 3Y is transferred onto the paper P. The residual toner remained on the first image carrier 3Y is removed by a cleaner 11.

A magenta toner image, a cyan toner image, and a black toner image are formed respectively on the second image carrier 3M, the third image carrier 3C, and the fourth image carrier 3K. Each of the toner images is transferred to the paper P in a sequentially manner. The paper P having the composite toner image of four colors is further transferred toward the fixing device 2 in the direction indicated by the arrow C.

The fixing device 2 fixes the toner image onto the paper P. After this fixing operation, the paper P is transferred to a discharging roller (not shown) to be discharged onto an output tray (not shown). Alternatively, the paper P may be reversed to the other side by a reversing unit (not shown), for another image forming operation.

Now, referring to FIGS. 2 to 11, exemplary structures of the fixing device 2 is explained.

Figure 2:
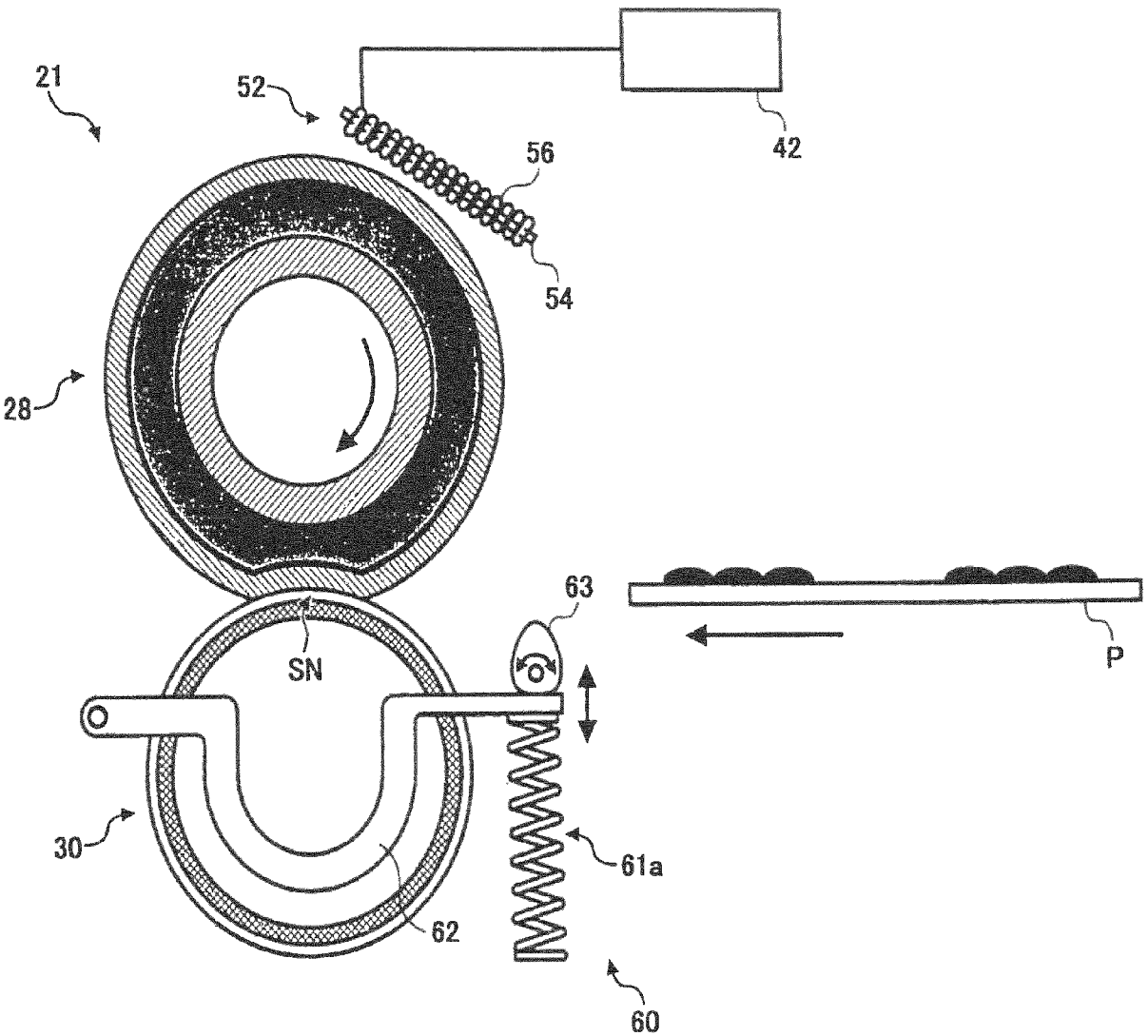
FIG. 2 is a schematic side view illustrating a fixing device according to an exemplary embodiment of the present invention.
Figure 3:
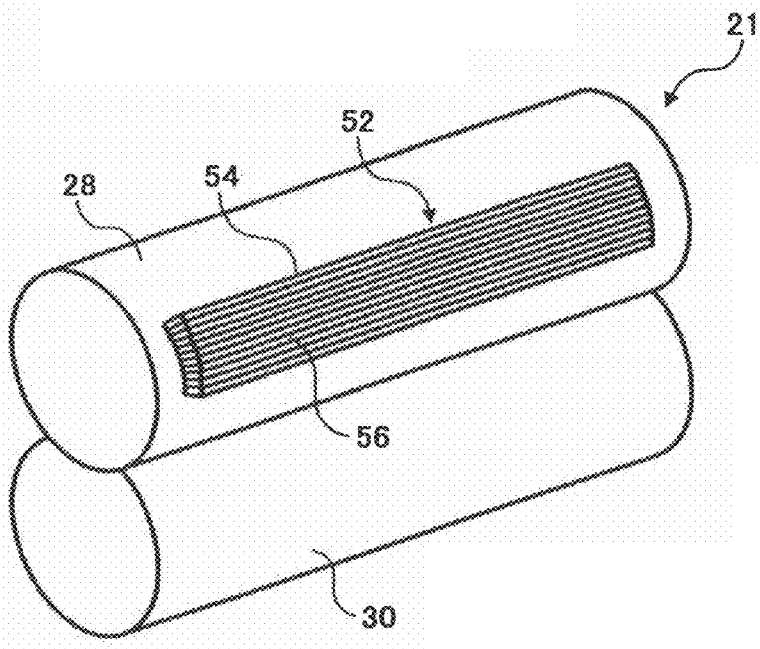
FIG. 3 is a perspective view illustrating a part of the fixing device shown in FIG. 2.

As shown in FIGS. 2 and 3, the fixing device 21 includes a heater 52, a controller 42, a fixing roller 28, a pressure roller 30, and a pressure controller 60.

The heater 52 preferably has a length of about 70 mm in the direction nearly parallel to the circumferential direction of the fixing roller 28. The heater 52 has a sleeve-like shape, extending in the axial direction of the fixing roller 28 (FIG. 3). The heater 52 includes a coil supporter 54, and a coil 56 wound around the coil supporter 54. The coil supporter 54 has a rod-like shape, and fixed at a predetermined position of the fixing device 21. The coil 56 is preferably implemented by a litz wire.

The controller 42 includes any kind of processor capable of controlling the fixing device 21. For example, the controller 42 controls the heater 52, or a drive source (not shown), such as a motor or an actuator, for driving the fixing roller 28 or the pressure controller 60. In this exemplary embodiment, the controller 42 is implemented by a printer controller of the image forming apparatus 100, which is a microcomputer including a CPU (central processing unit), a ROM (read only memory), a RAM (random access memory), and an I/O (input/output) interface.

Figure 4:
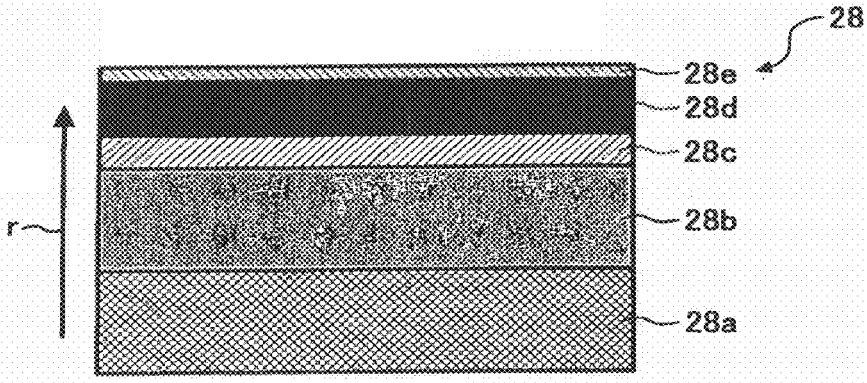
FIG. 4 is a schematic side view illustrating an exemplary structure of the fixing roller shown in FIG. 2.

The fixing roller 28 transmits a heat from the heater 52 to the paper P passing through the nip SN formed between the fixing roller 28 and the pressure roller 30. The fixing roller 28 is made of a plurality of layers formed one above the other. In this exemplary embodiment, as shown in FIG. 4, the fixing roller 28 includes a core 28*a*, a heat absorbing layer 28*b*, a heat emitting layer 28*c*, an elastic layer 28*d*, and a releasing layer 28*e*, from the inner side to the outer side, as indicated by the arrow r.

The core 28*a* is preferably made of metal, such as aluminum or steel, having a strength sufficient to prevent deflection of the fixing roller 28. Alternatively, the core 28*a* may be made of glass or ceramics. The thickness of the core 28*a* is preferably 2 mm to 3 mm, however, it is not limited to this example. Further, the core 28*a* has an outer radius of 50 mm, however, it is not limited to this example.

The heat absorbing layer 28*b* prevents a heat to transmit from the heat emitting layer 28*c* to the core 28*a*. The heat absorbing layer 28*b* is preferably made of foamed silicone rubber having a hardness of 5 to 50 based on the JIS-A standard. Alternatively, any kind of heat resistance material, such as elastomeric material including fluorocarbon rubber, may be used. Further, the thickness of the heat absorbing layer 28*b* is preferably around 4 mm, however, it is not limited to this example.

The heat emitting layer 28*c* is made of magnetic or non-magnetic metal. Preferably, magnetic stainless such as SUS430 and SUS410, iron, or nickel may be used. Alternatively, alloy based on any one of the above-mentioned metals may be preferably used. The thickness of the heat emitting layer 28*c* is preferably between 0.05 mm and 0.5 mm.

The elastic layer 28*d* is made of heat resistance eralstomeric material, such as silicon rubber or fluorocarbon rubber, for example. Preferably, any kind of material capable of transmitting a heat from the heat emitting layer 28*c* to the surface of the fixing roller 28 is used. To increase heat conductivity, filler metal may be combined. The thickness of the elastic layer 28*d* is preferably between 0.2 mm to 2 mm. The hardness of the elastic layer 28*d* is preferably below 30 based on the JIS-A standard.

The releasing layer 28*e* is optionally provided to increase releasability of the fixing device 28, and is preferably made of fluorocarbon resin such as PFA (Perfluoroalkoxy) and PTFE (PolyTetraFluoroEthylene), silicon resin, or silicon rubber. The thickness of the releasing layer 28*e* is preferably between 10 μm and 80 μm.

Figure 5:
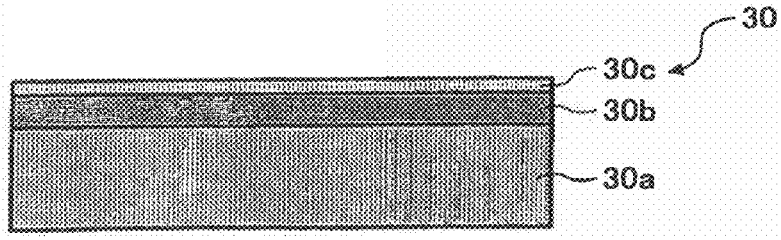
FIG. 5 is a schematic side view illustrating an exemplary structure of the pressure roller shown in FIG. 2.

The pressure roller 30, which faces the fixing roller 28, forms the nip SN with the fixing roller 28. The pressure roller 30 is made of a plurality of layers formed one above the other. In this exemplary embodiment, as shown in FIG. 5, the pressure roller 30 includes a core 30*a*, an elastic layer 30*b*, and a releasing layer 30*c*, from the inner side to the outer side.

The core 30*a* is made of metal, such as aluminum or steel. The thickness of the core 30*a* is preferably between 0.4 mm and 0.8 mm. The core 30*a* has an outer radius of 30 mm to 40 mm, however, it is not limited to this example.

The elastic layer 30*b* is made of silicon rubber, having a hardness of 30 to 60 based on the JIS-A standard, for example. The thickness of the elastic layer 30*b* is preferably between 0.2 mm and 1 mm.

The releasing layer 30*c* is optionally provided to increase releasability of the pressure roller 30, and is preferably made of fluorocarbon resin, having a thickness of about 50 μm.

The pressure controller 60 is capable of controlling a pressure generated at the nip SN. Further, the pressure controller 60 may control a distance of the nip SN, i.e., a distance between the fixing roller 28 and the pressure roller 30.

As shown in FIG. 2, the pressure controller 60 includes a pressure spring 61*a*, a roller supporter 62, and a cam 63. The cam 63 is rotatable in the direction indicated by the arrow. The roller supporter 62 moves the pressure roller 30 upward and downward, according to the position of the cam 63. The pressure spring 61*a*, which is attached to the roller supporter 62, extends or compresses along with the movement of the roller supporter 62.

In an exemplary operation, when the image forming apparatus 100 is in a waiting mode, the cam 63 is rotated at a first position. When the cam 63 is in the first position, the pressure roller 30 is positioned away from the fixing roller 28.

When the image forming apparatus 100 is activated, or switched from the waiting mode to an operating mode, such as by a user, the controller 42 sends a control signal to the driving source for rotating the fixing roller 28.

At the same time, the coil 56 of the heater 52 applies a current having a high frequency of about 20 kHz to 60 kHz to the surface of the fixing roller 28, which is rotatably driven. The heat emitting layer 28 of the fixing roller 28 is self heated by the Joule heat caused by the eddy current.

By applying a high frequency current of about 20 to 60 kHz to the coil 56, an eddy current is generated at the heating layer 28*c* of the fixing roller 28. With this Joule heat, the temperature of the heating layer 28*c* is increased. With this induction heating, the surface temperature of the fixing roller 28 can be raised to a temperature sufficient for melting the toner. Using the induction heating, the heating layer 28*c*, which is provided near the surface layer of the fixing roller 28, can be directly heated, thus reducing the start-up time.

When a predetermined time period passes, the controller 42 sends a control signal to the driving source. With this control signal, the cam 63 is rotated to a second position. When the cam 63 is in the second position, the roller supporter 62 moves the pressure roller 30 toward the fixing roller 21. The pressure spring 61*a* extends due to the reduced pressure from the roller supporter 62. As a result, the nip SN sufficient for fixing a toner image is formed between the fixing roller 28 and the pressure roller 30. Further, with the rotation of the fixing roller 28, the pressure roller 30 is rotated in the direction opposite to the direction of the fixing roller 28. The controller 42 then sends a control signal to start an image fixing operation. The paper P is then transferred to the nip SN.

In this exemplary embodiment, the above predetermined time period is a time needed for the surface of the fixing roller 28 to raise to a temperature for melting a toner. Information regarding this time period may be stored in the ROM of the controller 42, for example.

Further, in this exemplary embodiment, the surface of the pressure roller 30 is made harder than the surface of the fixing roller 28. Thus, as shown in FIG. 2, the surface of the fixing roller 28 is deformed under the pressure from the pressure roller 30 at the nip SN. With this deformation, the paper P passing through the nip SN is curved to form a convex shape. With this convex shape, the paper P can be easily separated from the fixing roller 28 after the image fixing operation.

In another exemplary operation, the controller 42 may wait for a predetermined time period, after the cam 63 is rotated at the second position and before the image fixing operation.

For example, the pressure roller 30, which is brought in contact with the fixing roller 28, is heated by the fixing roller 28. When a predetermined time period passes, the controller 42 sends a control signal to start an image fixing operation.

The above predetermined time period is a time needed for the surface of the pressure roller 30 to raise to a temperature substantially equal to the surface temperature of the fixing roller 28. Information regarding this time period may be stored in the ROM of the controller 42, for example.

Figure 6:
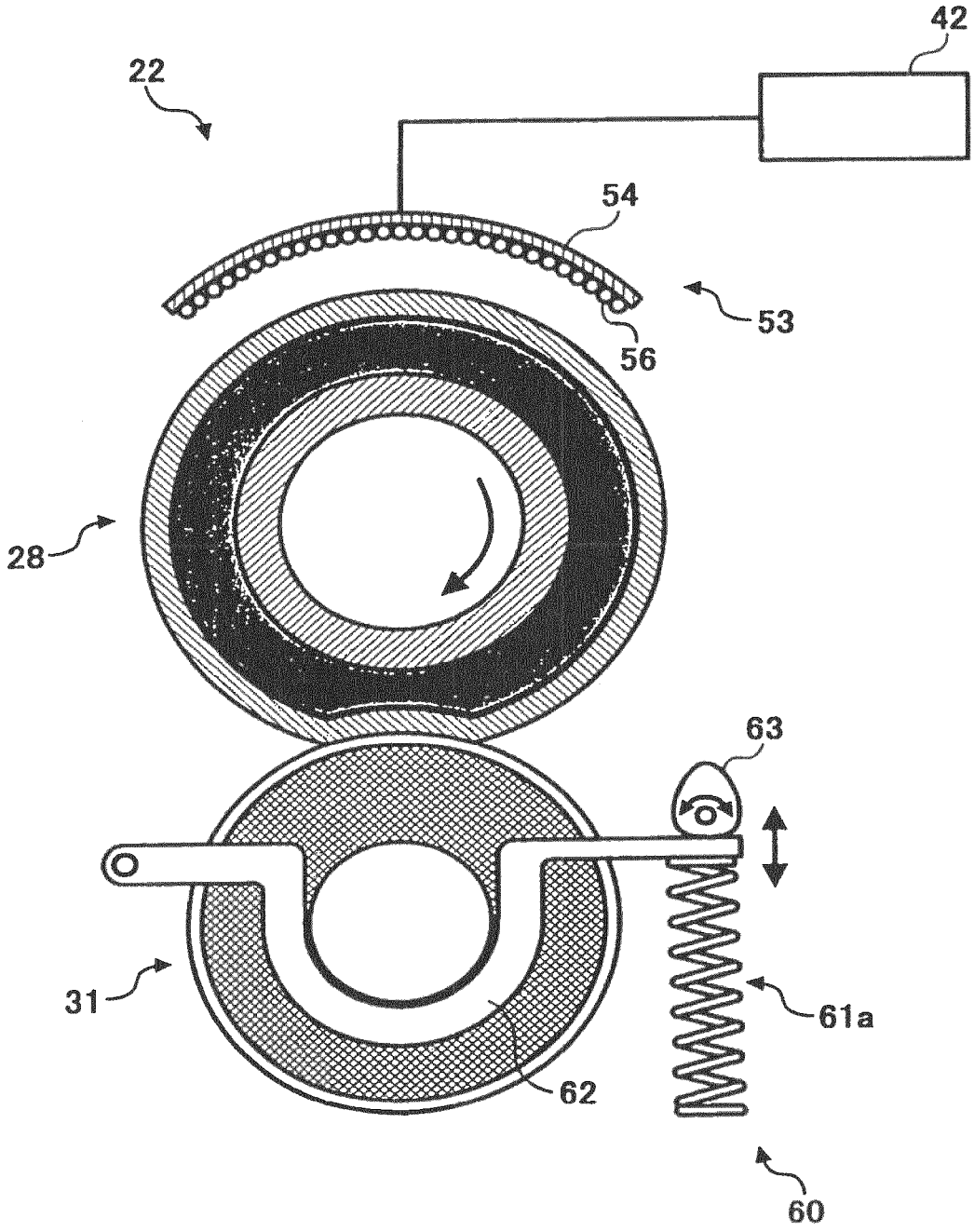
FIG. 6 is a schematic side view illustrating a fixing device according to an exemplary embodiment of the present invention.

The fixing device 22 of FIG. 6 is substantially similar in structure to the fixing device 21 of FIG. 2. The differences include the heater 53 and the pressure roller 31.

The heater 53 is curved along the circumferential direction of the fixing roller 28. Further, the coil 56 is wound around the coil supporter 54, having a plate-like shape, in the axial direction of the fixing roller 28.

The pressure roller 31 is made of a plurality of layers, including the core 30*a*, the elastic layer 30*b*, and the releasing layer 30*c*, as shown in FIG. 5. However, the elastic layer 30*b* of the pressure roller 31 has a thickness of about 5 mm to 10 mm. The thicker elastic layer 30*b* may suppress a heat to transmit from the surface of the pressure roller 31 to the core 30*a*.

Figure 7:
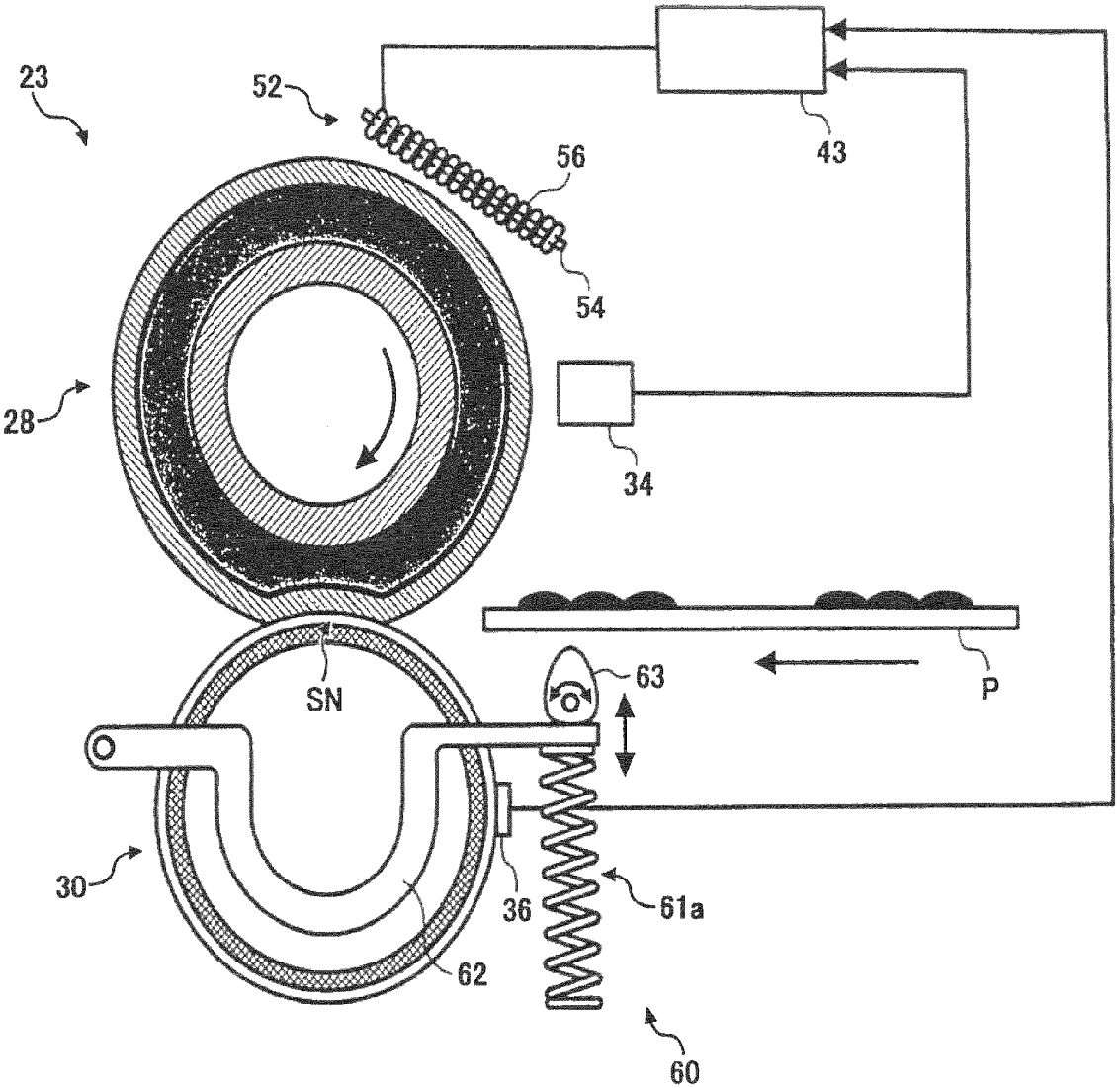
FIG. 7 is a schematic side view illustrating a fixing device according to an exemplary embodiment of the present invention.

The fixing device 23 of FIG. 7 is substantially similar in structure to the fixing device 21 of FIG. 2. The differences include the fixing roller detector 34, the pressure roller detector 36, and the controller 43.

The fixing roller detector 34 detects a surface temperature of the fixing roller 28. As shown in FIG. 7, the fixing roller detector 34 is provided remote from the surface of the fixing roller 28. This requires the fixing roller detector 34 to detect a surface temperature without contacting the surface of the fixing roller 28. For this reason, the fixing roller detector 34 is preferably implemented by an infrared detector, such as a thermopile, for example.

Alternatively, the fixing roller detector 34 may be provided in contact with the surface of the fixing roller 28. However, this may accelerate wear of the fixing roller 28.

The pressure roller detector 36 detects a surface temperature of the pressure roller 30. As shown in FIG. 7, the pressure roller detector 36 may be provided in contact with the surface of the pressure roller 36, since the pressure roller 36 is made harder in this exemplary embodiment.

Alternatively, the pressure roller detector 36 may be provided remote from the surface of the pressure roller 36, as long as it is capable of detecting the surface temperature.

In this exemplary embodiment, one fixing roller detector 34 and one pressure roller detector 36 are provided. However, the number of detectors is not limited to this example, as long as at least the surface of the fixing roller 28 can be measured. Further, the position of the detector 34 or 36 is not limited to the position shown in FIG. 7.

The controller 43 is substantially similar in structure to the controller 42. However, the controller 43 may operate differently from the controller 42.

In an exemplary operation, when the image forming apparatus 100 is in the waiting mode, the pressure roller 30 is positioned away from the fixing roller 28.

When the image forming apparatus 100 is activated, or switched from the waiting mode to the operating mode, the controller 43 sends a control signal to the driving source for rotating the fixing roller 28.

At the same time, the heater 56 applies a heat to the fixing roller 28, which is rotatably driven, in a substantially similar manner as described referring to FIG. 2.

The fixing roller detector 34 constantly measures a surface temperature of the fixing roller 28, and the measured temperatures are checked by the controller 43. When the surface temperature reaches a predetermined temperature, the controller 43 sends a control signal to rotate the cam 63 to the second position. As a result, the pressure roller 30 moves upward toward the fixing roller 28, and forms the nip SN for an image fixing operation.

In this exemplary embodiment, the predetermined temperature is a temperature sufficient for melting a toner. Information regarding this temperature may be stored in the ROM of the controller 43, for example.

In addition, the controller 43 may additionally check a surface temperature of the pressure roller 30.

In an exemplary operation, the pressure roller detector 36 constantly measures a surface temperature of the pressure roller 30, and the measured temperatures are checked by the controller 43. When the surface temperature of the pressure roller 36 reaches a predetermined temperature, which is substantially equal to the predetermined temperature of the fixing roller 28, the controller 43 sends a control signal to start an image fixing operation.

Figure 8:
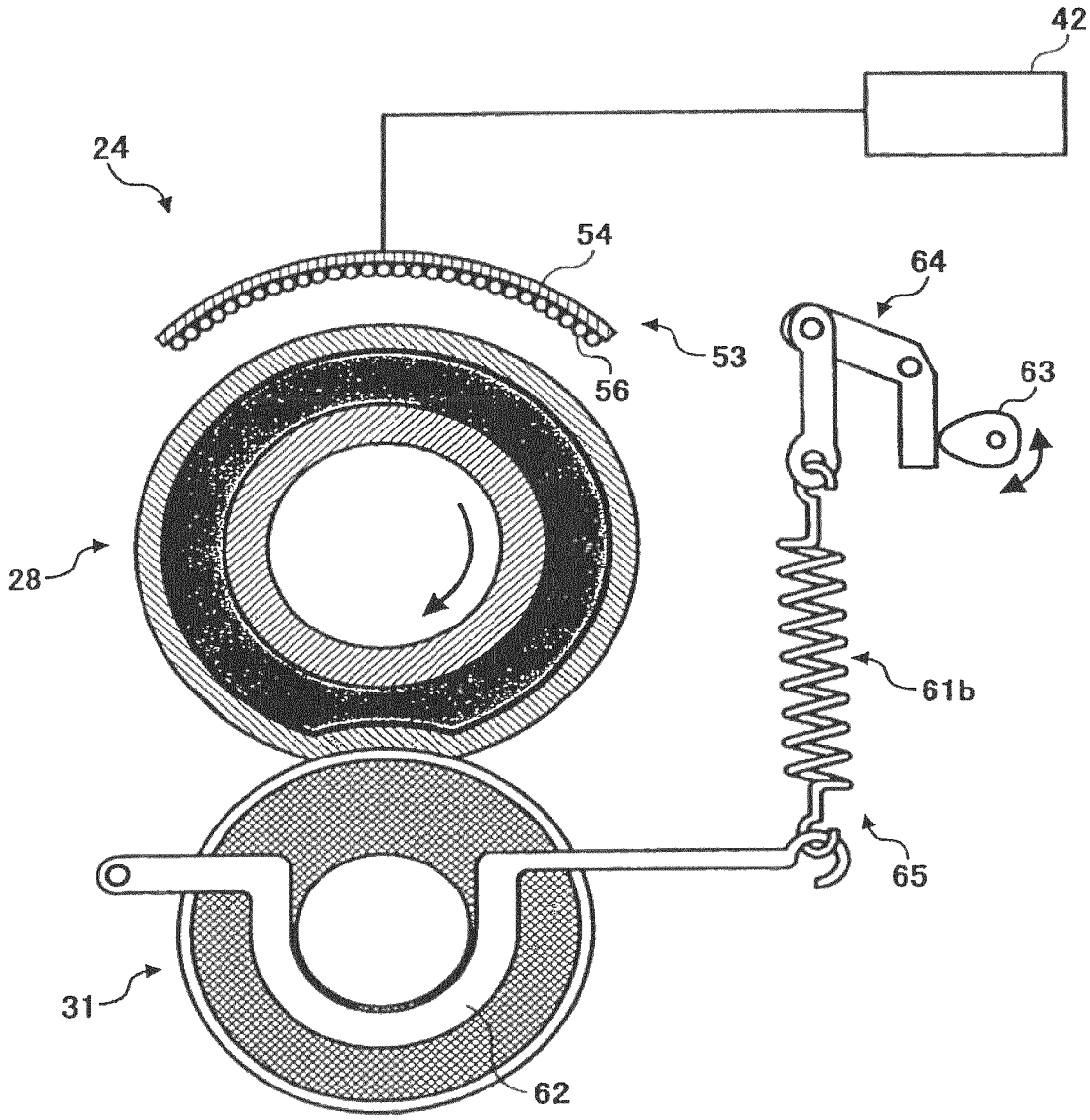
FIG. 8 is a schematic side view illustrating a fixing device according to an exemplary embodiment of the present invention.

The fixing device 24 of FIG. 8 is substantially similar in structure to the fixing device 22 of FIG. 6. The differences include the pressure controller 65.

The pressure controller 65 is capable of controlling a pressure generated at a nip formed between the fixing roller 28 and the pressure roller 31. As shown in FIG. 8, the pressure controller 65 includes a pressure spring 61*b*, the roller supporter 62, the cam 63, and a pressure lever 64.

The cam 63 is rotatable in the direction indicated by the arrow. The pressure lever 64 is moved upward or downward, according to the position of the cam 63. The pressure spring 61*b*, which connects the pressure lever 64 and the roller supporter 62, extends or compresses along the movement of the pressure lever 64. The roller supporter 62 moves upward or downward, according to the extension or compression of the pressure spring 61*b*.

When the cam 63 is moved to the first position upon receiving a control signal from the controller 42, the pressure lever 64 is moved downward, and compresses the spring 61*b*. The compressed spring 61*b* moves the pressure roller 31 slightly away from the fixing roller 28.

When the cam 63 is moved to the second position upon receiving a control signal from the controller 42, the pressure lever 64 is moved upward, and extends the spring 61*b*. The extended spring 61*b* moves the pressure roller 31 slightly toward the fixing roller 28.

In this exemplary embodiment, the fixing roller 28 and the pressure roller 30 may not be separated to have a large distance, as long as the pressure generated at the nip SN is reduced.

Figure 9:
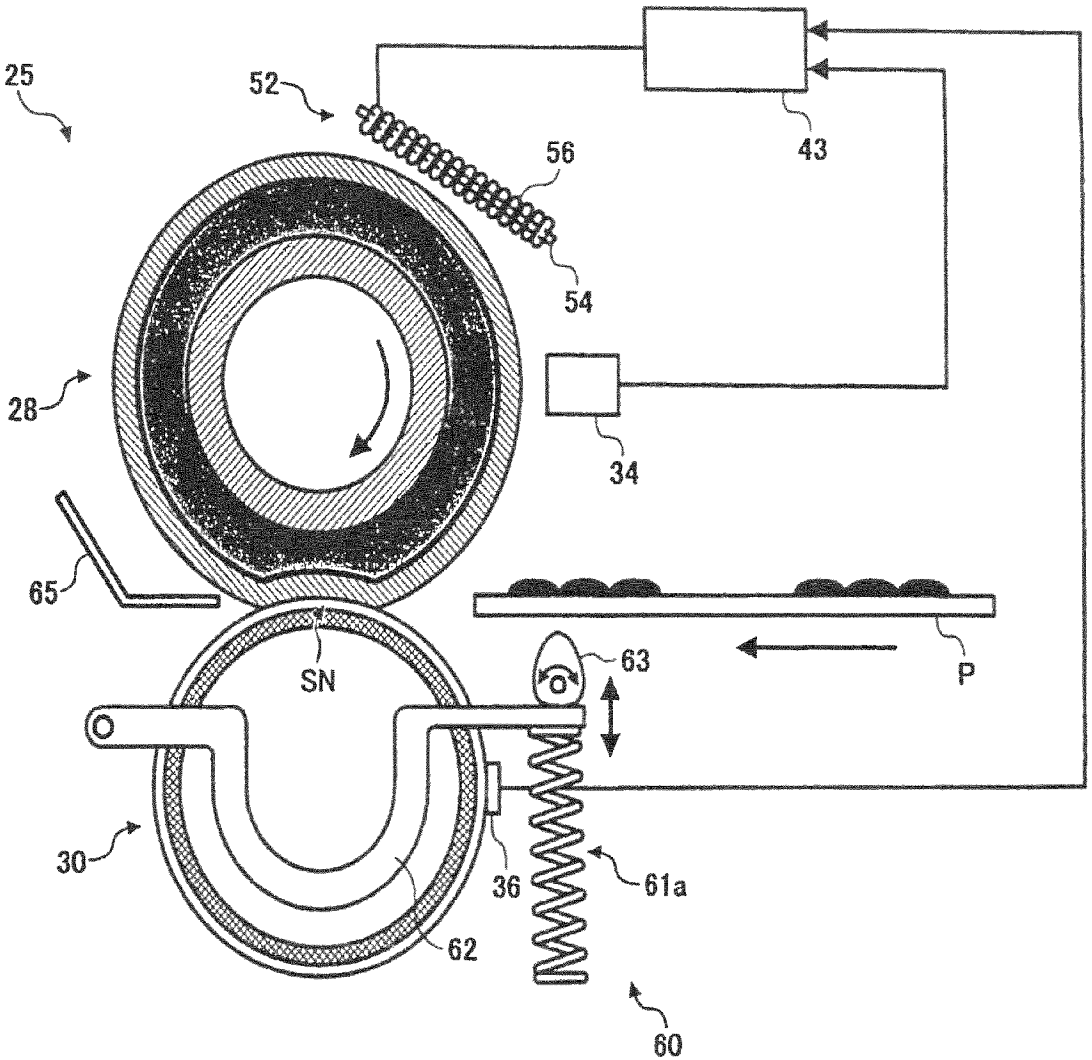
FIG. 9 is a schematic side view illustrating a fixing device according to an exemplary embodiment of the present invention.

The fixing device 25 of FIG. 9 is substantially similar in structure to the fixing device 23 of FIG. 7. The differences include the separator 65.

The separator 65 separates the paper P, which has passed through the nip SN, from the fixing roller 28. As shown in FIG. 9, the separator 65 is provided remote from the surface of the fixing roller 28 and in parallel to the nip SN.

Alternatively, the separator 65 may be provided in contact with the surface of the fixing roller 28. However, this may accelerate wear of the fixing roller 28.

Figure 10:
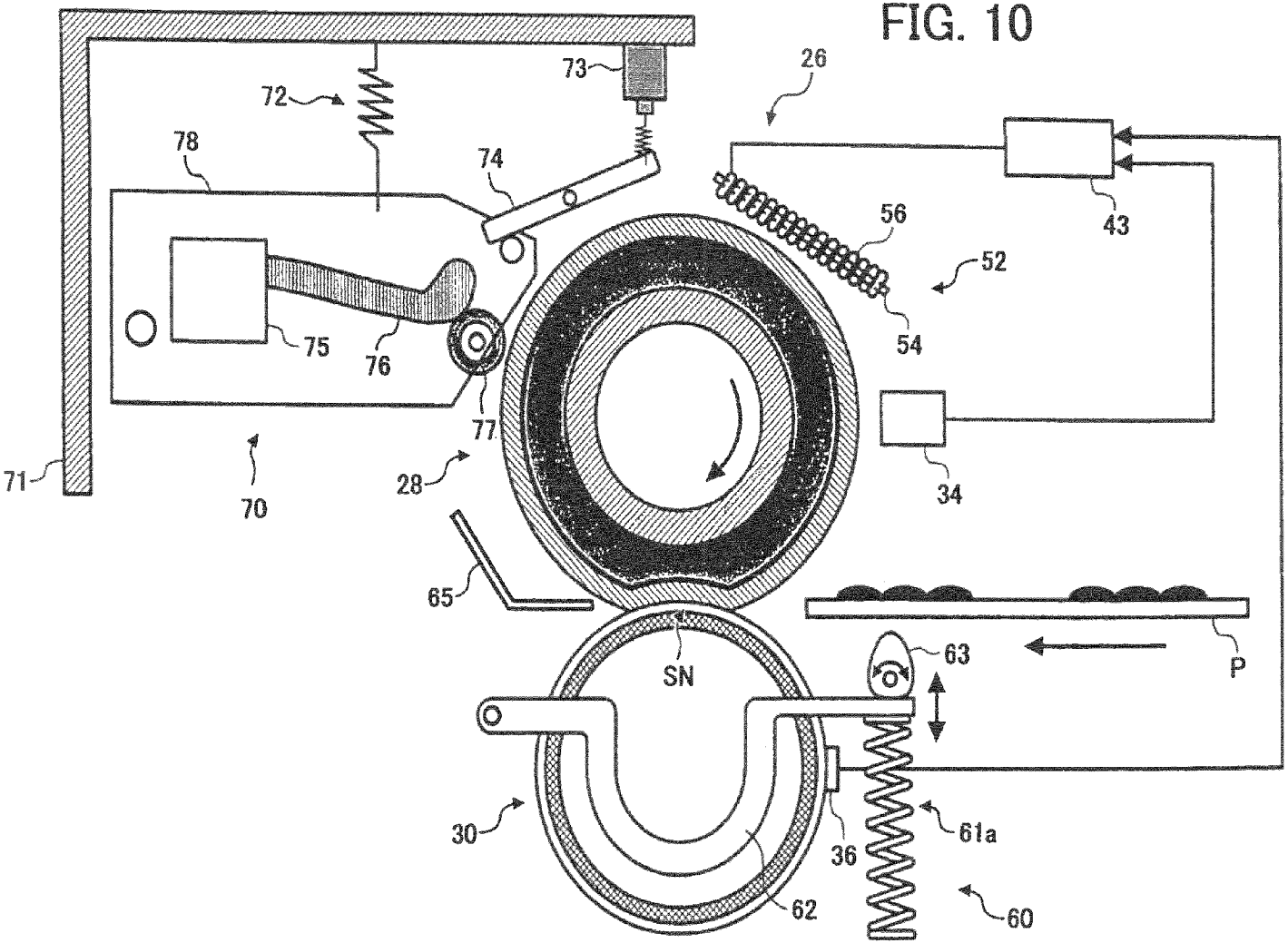
FIG. 10 is a schematic side view illustrating a fixing device according to an exemplary embodiment of the present invention.

The fixing device 26 of FIG. 10 is substantially similar to the fixing device 23 of FIG. 7. The differences include the releasing agent applying member 70, which applies a releasing agent to the surface of the fixing roller 28. In this exemplary embodiment, the releasing layer 28*e* may not be provided.

As shown in FIG. 10, the applying member 70 includes a frame 71, a spring 72, a solenoid 73, a swinging member 74, and a casing 78 having a tank 75, a supplier 76, and an applying roller 77.

The tank 75 stores a releasing agent, such as a releasing agent having silicon oil. The supplier 71, which is made of felt, has one end dipped into the tank 75 and the other end contacting the surface of the applying roller 77. The applying roller 77 applies the releasing agent, supplied by the supplier 76, to the surface of the fixing roller 28. The tank 75, the supplier 76, and the applying roller 77 are accommodated in the casing 78.

The frame 71 is fixed at a predetermined position in the fixing device 26.

The spring 72 has one end attached to the frame 71 and the other end attached to the casing 78.

The solenoid 73 has one end surface attached to the frame 71, and the other end connected to the swinging member 74 via a flexible member, such as a spring.

The swinging member 74, which is attached to the casing 78, swings at its center.

When the solenoid 73 has no current flowing in, the swinging member 74 moves upward, while compressing the spring 72. The compressed spring 72 and the swinging member 74 keep the position of the casing 78 to be away from the surface of the fixing roller 28.

When the solenoid 73 has a current flowing in, the swinging member 74 moves downward, while extending the spring 72. The extended spring 72 and the swinging member 74 move the position of the casing 78 toward the surface of the fixing roller 28.

In an exemplary operation, when the image forming apparatus 100 is in a waiting mode, the solenoid 73 has no current flowing in. Thus, the applying roller 77 is kept away from the surface of the fixing roller 28.

When the image forming apparatus 100 is activated, or switched from the waiting mode to an operating mode, such as by a user, the controller 42 causes the fixing roller 28 to rotate, as described referring to FIG. 2, for example. At the same time, the controller 42 sends a control signal for sending a current to the solenoid. The applying roller 77, which is moved to a position in contact with the surface of the fixing roller 28, can apply a releasing agent to the fixing roller 28.

Figure 11:
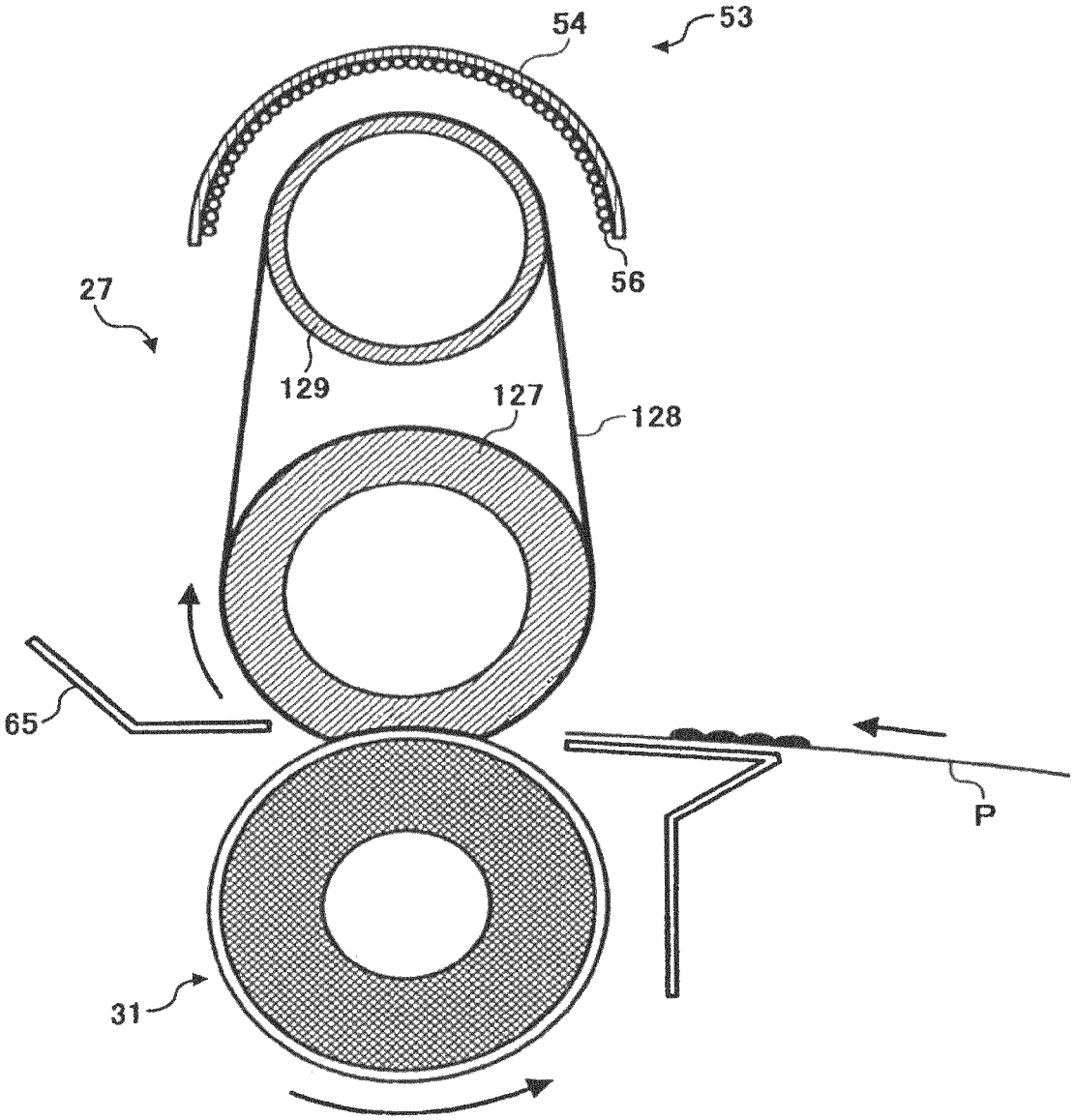
FIG. 11 is a schematic side view illustrating a fixing device according to an exemplary embodiment of the present invention.

The above-described fixing devices or other fixing devices of the present invention may be implemented to have a fixing belt, for example, as illustrated in FIG. 11.

The fixing device 27 of FIG. 11 includes a fixing belt 128, a roller 129, an elastic roller 127, the pressure roller 31, the heater 53, and the separator 65. In this exemplary embodiment, the fixing belt 128 is heated by the heater 53, while rotating around the roller 129 and the elastic roller 127.

Numerous additional modifications and variations are possible in light of the above teachings. It is therefore to be understood that within the scope of the appended claims, the disclosure of this patent specification may be practiced otherwise than as specifically described herein.

For example, elements and/or features of different illustrative embodiments may be combined with each other and/or substituted for each other within the scope of this disclosure and appended claims.

Further, in any one of the above-described exemplary embodiments, the controller may control an operation of the fixing device, by switching operation modes of the fixing device.

For example, when the fixing device is in a waiting mode, the cam is at the first position. Accordingly, the pressure roller is kept away from the fixing roller.

The fixing device is then switched from the waiting mode to a warm-up mode. In the warm-up mode, the fixing roller is rotated, and heated by the heater.

The fixing device is switched from the warm-up mode to a fixing mode, when a predetermined time period passes or when a surface temperature of the fixing roller reaches a predetermined value. In the fixing mode, the cam is rotated to the second position. Accordingly, the pressure roller is moved toward the fixing roller. Subsequently, an image fixing operation is performed.

In another example, the fixing device may be switched from the waiting mode to a first warm-up mode. In the first warm-up mode, the fixing roller is rotated, and heated by the heater.

The fixing device is then switched from the first warm-up mode to a second warm-up mode, when a predetermined time period passes or when a surface temperature of the fixing roller reaches a predetermined value. In the second warm-up mode, the cam is rotated to the second position. Accordingly, the pressure roller is moved toward the fixing roller, and starts rotating along with the rotation of the fixing roller.

The fixing device is switched from the second warm-up mode to a fixing mode, when a predetermined time period passes or when a surface temperature of the pressure roller reaches a predetermined value. In the fixing mode, an image fixing operation is performed.

Furthermore, in any one of the above-described exemplary embodiments, the pressure controller may be provided to move the position of the fixing roller.

In addition to the embodiments described above, other examples of the invention are provided in the following description.

As described above, when using the method of partially heating a fixing member having low heat capacity by heating means located outside of the nip, it is necessary to rotate the fixing member when heating. Since the fixing member has low heat capacity, if the fixing member is heated while it is not rotated, the temperature of the fixing member will reach abnormally high temperature of equal to or greater than 200 degree C. in one or two seconds.

In light of the above, the fixing member needs to be rotated when being heated during the start-up time. While heating only the belt is appropriate, the heat may be lost to the pressure roller or the elastic layer inside the fixing member due to the rotation of the fixing member. In order to reduce the start-up time, it is important to consider how the temperature of the fixing member can be increased without heating other members.

When the method of fixing at the nip after heating the fixing member having low heat capacity by outside heating means is used, the start-up time period is not 0 such that about a few or several seconds to 30 seconds are needed.

In order to reduce electric power consumption, ideally, the electric power supply to the fixing device should be 0 at the time of waiting. However, it is necessary to provide, and it is generally provided, a mode that allows the fixing device to return to the normal state during the start-up time period that is sufficiently short not to cause much stress for the user. Since this usability is prioritized, the electric power is supplied to the fixing device during the waiting state to keep the fixing member at a predetermined temperature.

As described above, when using the method of partially heating the fixing member by the outside heating means, the fixing member should be rotated when being heated such that the fixing member needs to be constantly rotated during the waiting state. When constantly rotating the fixing member at the time of waiting, the releasing layer provided on the surface of the fixing member is degraded due to the friction caused at the time of rotation such that life of the fixing member may be shortened.

In view of the above, an object of the present invention is to provide a fixing device having longer life while reducing the start-up time period and improving usability of the user. Another object of the present invention is to provide an image forming apparatus provided with such fixing device.

The above-described objectives of the present invention can be achieved by the following means. According to a first aspect of the present invention, a fixing device, which fixes an unfixed image formed on a recording medium at a fixing nip, includes a fixing member, a pressure rotator facing the fixing member configured to form the fixing nip with the fixing member, a heating source configured to partially heat the fixing member at a position other than the fixing nip, and controlling means. The fixing device further includes a pressure rotator separating mechanism for moving the pressure rotator away from the fixing member. During the waiting state, the controlling means heats the fixing member while rotating the fixing member and keeping the pressure rotator away from the fixing member, and keeps the fixing member at a predetermined temperature.

According to a second aspect of the present invention, a fixing device, which fixes an unfixed image formed on a recording medium at a fixing nip, includes a fixing member, a pressure rotating facing the fixing member configured to form the fixing nip with the fixing member, a heating source configured to partially heat the fixing member at a position other than the fixing nip, and controlling means. The fixing device further includes a pressure adjusting mechanism for reducing a pressure generated by the pressure rotator against the fixing member. During a waiting state, the fixing device heats the fixing member while rotating the fixing member, while reducing the pressure generated by the pressure rotator against the fixing member, and keeps the fixing member at a predetermined temperature.

According to a third aspect of the present invention, the fixing device according to the first or second aspect of the present invention further includes means for detecting a surface temperature of the fixing roller. The means for detecting detects the surface temperature while being in non-contact with the fixing member.

According to a fourth aspect of the present invention, the fixing device according to the first or second aspect of the present invention further includes means for separating transfer paper and the fixing member, which does not contact the fixing member.

According to a fifth aspect of the present invention, the fixing device according to the first or second aspect of the present invention further includes a mechanism configured to separate a releasing agent applying member, which is in contact with the fixing member in a normal state, from the fixing member to make the releasing agent applying member in non-contact with the fixing member. During the waiting time, the controlling means separates the releasing agent applying member from the fixing member in conjunction with operation of separating the pressure rotator or reducing the pressure generated by the pressure rotator.

According to a sixth aspect of the present invention, the fixing device, which fixes an unfixed image formed on a recording medium at a fixing nip, includes a fixing member, a pressure rotator facing the fixing member configured to form the fixing nip with the fixing member, a heating source configured to partially heat the fixing member at a position other than the fixing nip, and a controlling means. The fixing device further includes a pressure rotator separating mechanism for moving the pressure rotator away from the fixing member. During a start-up state, the controlling means heats and rotates the fixing member the pressure rotator is positioned away from the fixing member, and brings the pressure rotator into pressure contact with the fixing member after the fixing member reaches a predetermined temperature.

According to a seventh aspect of the present invention, the fixing device, which fixes an unfixed image formed on a recording medium at a fixing nip, includes a fixing member, a pressure rotator facing the fixing member configured to form the fixing nip with the fixing member, a heating source configured to partially heat the fixing member at a position other than the fixing nip, and a controlling means. The fixing device further includes a pressure adjusting mechanism for adjusting a pressure generated by the pressure rotator against the fixing member. During a start-up state, the controlling means heats the fixing member while rotating the fixing member, and brings the pressure generated by the pressure rotator to the pressure generated at the normal state after the fixing member reaches a predetermined temperature.

According to an eighth aspect of the present invention, the fixing device according to the sixth aspect of the present invention completes the start-up state by performing two step rotating modes, which includes a first start-up mode, in which, while the pressure rotator is positioned away from the fixing member, the fixing member is heated and rotated until the fixing member reaches the predetermined temperature or the fixing member is heated and rotated for a predetermined time period; and a second start-up mode, performed after the first start-up mode, in which the fixing member is heated and rotated while the pressure rotator is brought into contact with the fixing member.

According to a ninth aspect of the present invention, the fixing device according to the seventh aspect of the present invention completes the start-up state by performing the two step rotation modes, which includes a first start-up mode in which, while the pressure generated by the pressure rotator against the fixing member is reduced, the fixing member is heated and rotated until the fixing member reaches the predetermined temperature or the fixing member is heated and rotated for a predetermined time period; and a second start-up mode, performed after the first start-up mode, in which the fixing member is heated and rotated while the pressure rotator is brought into pressure contact with the fixing member.

According to a tenth aspect of the present invention, an image forming apparatus is provided, which includes the fixing device according to any one of the first to ninth aspects of the present invention.

According to the fixing device of one aspect of the invention, during the waiting state, the fixing member is heated and rotated while the fixing member is positioned away from the pressure rotator. Accordingly, it is possible to return from the waiting state to the fixing state in which fixing is possible, without spending the substantial amount of time for waiting, and without shortening life of the fixing member.

According to the fixing device of another aspect of the invention, during the waiting state, the fixing member is heated and rotated while the pressure generated by the pressure rotator against the fixing member is reduced. Accordingly, it is possible to return from the waiting state to the fixing state in which fixing is possible, without spending the substantial amount of time for waiting, and while minimizing shortening of life of the fixing member.

Another aspect of the fixing device further includes means for detecting that detects a surface temperature of the fixing member. Since the means for detecting detects the temperature while being in non-contact with the fixing member, shortening of life of the fixing member may be prevented, which may be caused by partial degradation of the surface of the fixing member due to the friction generated between the fixing member and the means for detecting.

Another aspect of the fixing device includes means for separating (for example, a separating pawl), which separates the transfer paper from the fixing member. Since the means for separating is in non-contact with the fixing member, shortening of life of the fixing member may be prevented, which may be caused by partial degradation of the surface of the fixing member due to the friction generated between the fixing member and the means for separating.

Another aspect of the fixing device further includes a member (for example, a silicon oil applying roller), which is in contact with the fixing member in a normal state, is brought into non-contact with the fixing member in conjunction with operation of moving the pressure rotator or reducing the pressure generated by the pressure rotator. Thus, shortening of life of the fixing member may be prevented, which may be caused by partial degradation of the surface of the fixing member due to the friction generated at the fixing member. Additionally, applying an excess amount of silicon oil during the start-up time is prevented.

In another aspect of the fixing device, during the start-up time, the fixing member is heated and rotated while the fixing member is positioned away from the pressure rotator. When the fixing member reaches a predetermined temperature, the pressure rotator is brought into pressure contact with the fixing member. Accordingly, time it takes for increasing the temperature of the fixing member can be reduced while minimizing the heat loss to the pressure rotator during the start-up time. Thus, ununiformed fixed state caused due to the ununiformed temperature of the fixing member or the pressure rotator is prevented while minimizing the heat loss to the pressure rotator during the start-up time.

In another aspect of the fixing device, during the start-up time, the fixing member is heated and rotated while the pressure generated by the pressure rotator is reduced. When the fixing member reaches a predetermined temperature, the pressure generated by the pressure rotator is brought to the pressure generated at the normal state. Accordingly, time it takes for increasing the temperature of the fixing member can be reduced while minimizing the heat loss to the pressure rotator during the start-up time. When compared with the case of moving the pressure rotator away from the fixing member, the time it takes for increasing the temperature of the fixing member can be reduced with minimized work.

In another aspect of the fixing device, the start-up state is completed by performing two step rotation modes, which includes: a first start-up mode in which, while the pressure rotator is positioned away from the fixing member, the fixing member is heated and rotated until the fixing member reaches the predetermined temperature or the fixing member is heated and rotated for a predetermined time period; and a second start-up mode, performed after the first start-up mode, in which the fixing member is heated and rotated while the pressure rotator is brought into contact with the fixing member. Thus, ununiformed fixed state caused due to the ununiformed temperature of the fixing member or the pressure rotator is prevented while minimizing the heat loss to the pressure rotator during the start-up time.

According to another aspect of the fixing device, the start-up state is completed by performing two step rotation modes, the modes comprising: a first start-up mode in which, while the pressure generated by the pressure rotator against the fixing member is reduced, the fixing member is heated and rotated until the fixing member reaches the predetermined temperature or the fixing member is heated and rotated for a predetermined time period; and a second start-up mode, performed after the first start-up mode, in which the fixing member is heated and rotated while the pressure rotator is brought into pressure contact with the fixing member. Thus, ununiformed fixed state caused due to the ununiformed temperature of the fixing member or the pressure rotator is prevented while minimizing the heat loss to the pressure rotator during the start-up time. When compared to the case of moving the pressure rotator away from the fixing member, the time it takes for increasing the temperature can be reduced with minimized work.

According to another aspect of the fixing device, since any one of the above-described fixing devices is provided, an image forming apparatus can be returned to the normal state without spending the substantial amount of waiting time, while improving usability of the user without shortening life of the fixing member.

Detailed description of certain examples of the invention are provided below with reference to the figures.

The pressure roller 30, which functions as the pressure rotator, includes a metal core 30*a* of aluminum or iron having the outer diameter of 30 to 40 mm and the thickness of 0.4 to 0.8 mm; and an elastic layer 30*b* that covers the surface of the metal core 30*a*. The elastic layer 30*b* is formed of silicon rubber having the JIS-A hardness of 30 to 60 and has the thickness of 0.2 to 1 mm. Preferably, a surface releasing layer 30*c* is formed on the outer side of the elastic layer 30*b*, which is made of fluorocarbon resin with the thickness of about 50 μm, in order to increase releasability. The pressure roller 30 is brought into pressure contact with the fixing roller 28 by biasing means, not illustrated.

As illustrated in FIG. 5, the pressure roller 30 may have the structure having a surface releasing layer 30*c* having the thickness of about 50 μm at the outer side of the elastic layer 30*b* having the thickness of 5 to 10 mm.

Referring to FIGS. 2, 4, and 5, the fixing roller 28 is made of the structure softer than the surface hardness of the pressure roller 30. For this reason, as illustrated in figures, at the fixing nip portion, the pressure roller 30 is pressed against the fixing roller 28 such that the elastic layer 28*d* and the heat insulating layer 28*b* are deformed. With this structure, the transfer paper P is curved at the fixing nip portion SN so as to form the convex shape against the fixing roller 28, thus making the transfer paper P to be easily separated from the fixing roller 28 after fixing. Referring to FIG. 2, the fixing nip portion SN corresponds to the concaved portion of the fixing roller caused by the pressure roller.

The fixing roller 28 is driven by a motor and a transmission gear, not illustrated, and drives the pressure roller 30.

According to this example, as illustrated in FIG. 2, a mechanism (pressure rotator separating mechanism) for moving the fixing member 28 away from the pressure roller 30 is provided. The controlling means rotates a cam 63 by a drive source not illustrated, and moves a pressure lever 62 supporting the pressure roller 30 upward or downward, thus moving the pressure roller 30 away from the fixing member 28.

According to this example, when the method of heating the fixing member 28 having low heat capacity outside the nip formed between the fixing member 28 and the pressure roller 30 is used, the fixing member 28 needs to be rotated while being heated. Since the fixing member 28 has low heat capacity, if it is partially heated while being unrotated, the heated portion reaches 200 degree C. or greater for 1 or 2 seconds. By rotating the fixing member 28 while rotating, the entire circumference of the fixing member 28 is heated. If the fixing member 28 is heated while being rotated, heat may be lost to the pressure roller 30 or the inner side of the fixing member 28 due to the rotation, while it is preferable to heat only the surface of the fixing member 28.

According to this example, during the start-up time, the cam 63 is rotated such that the pressure roller 30 is positioned away from the fixing member 28, and heating and rotating is performed. When the fixing member 28 reaches a predetermined temperature or a predetermined time period passes, the cam 63 is rotated such that the pressure roller 30 is brought into pressure contact with the fixing member 28, while heating and rotating.

The start-up is completed by performing a first start-up mode in which the fixing member 28 is heated and rotated while the pressure roller 30 is positioned away from the fixing member 28, and a second start-up mode in which the fixing member 28 is heated and rotated while the pressure roller 30 is made in contact with the fixing member 28. If the second start-up mode is not performed, fluctuation in temperature between the fixing member 28 and the pressure rotator 30 in the direction of rotating may be high when performing fixing. As a result, the unevenness in gloss may be caused or fixing may be partially insufficient. By performing the start-up state through two modes, fluctuations in temperature between the fixing member 28 and the pressure rotator 30 may be suppressed while minimizing heat loss from the fixing member 28 to the pressure roller 30 during the start-up time.

In order to keep the waiting state in which the fixing device can quickly return to the normal state, it may be necessary to heat the fixing member while rotating the fixing member. If the fixing member is heated and rotated while the pressure roller is in pressure contact with the fixing member, the surface of the fixing member may be degraded due to the friction generated with the pressure roller, thus shortening life of the fixing member. According to this example, for the user who prefers usability (waiting time is 0) over reduced power consumption, it may be necessary to heat the fixing member during the waiting time such that the fixing device can quickly returns to the fixing operation after the waiting time. For this reason, during the waiting time, the fixing member is heated and rotated while the pressure roller is positioned away from the fixing member to keep the fixing member at a predetermined temperature, while extending life of the fixing member.

The fixing member is provided with means for detecting, which detects a surface temperature of the fixing member, and controls heating. According to this example, the thermopile 34 is provided, which detects infrared rays from the surface of the fixing member 28 to measure the temperature. When heating and rotating the fixing member 28, partial degradation of the surface of the fixing member caused due to friction generated with the temperature detecting means is prevented. Since the temperature detecting means is provided in non-contact with the fixing member, life of the fixing member can be extended, as it is generally known. Especially in this example, in which the fixing member 28 needs to be rotated even during the start-up time or waiting time, the time in which the fixing device rotates may be increased by 10 times or more when compared with the generally-used fixing device, depending on how the user operates. For this reason, the temperature detecting means needs to be provided in this example. By providing the temperature detecting means, the fixing device can be provided with reduced start-up time, improved usability, and improved durability.

In a vicinity of the nip of the fixing member 28, separating means 65 is provided. In order to prevent the transfer paper P after fixing from being sticked to the fixing member or wound around the fixing member due to the melted toner, the separating means 65 is provided to mechanically separate the transfer paper P from the fixing member 28. According to this example, the separating means 65 is provided in the vicinity of the fixing member 28, but it is not in contact with the fixing member. In order to improve separability, a separating sprawl may be made in contact with the fixing member. For the same reason described above referring to the case of the temperature detecting means, it is necessary to make the separating means 65 in non-contact with the fixing member 28, thus preventing degradation of the surface of the fixing member 28 due to friction generated at the time of rotation.

The fixing member is further provided with an applying roller, which functions as applying means, for applying silicon oil, which is the releasing agent, to the surface of the fixing member. By lightly and uniformly applying silicon oil to the surface of the fixing member, releasability between the fixing member and the melted toner is improved, thus preventing offset of the toner to the fixing member or the transfer paper from wounding around the fixing member. According to this example, since the fixing member is heated and rotated at the waiting time, the releasing agent may be consumed despite the number of sheets passing through if the releasing agent is applied during the waiting time. In order to prevent this, a separating mechanism is provided to separate the releasing agent applying roller from the fixing member. Since the applying roller is moved away in conjunction with operation of positioning the pressure roller away from the fixing member during the waiting time, consumption of the releasing agent may be minimized.

According to another example embodiment of the present invention, as illustrated in FIG. 8, the mechanism for adjusting the pressure generated by the pressure roller 31 (the pressure adjusting mechanism) may be provided. The pressure adjusting mechanism is controlled by the control means. The control means adjusts the pressure by controlling a drive source (such as a motor or an actuator) of a cam such that the cam 63 is rotated, moving the pressure adjusting lever 64, and expanding or contracting the pressure spring 61*b*. Unlike the above-described example embodiment, the pressure roller 31 is not moved in a distance from the fixing member 28. However, the size of the nip formed between the fixing member 28 and the pressure roller 31 is reduced by reducing the amount of pressure. As described above referring to the example embodiment, at the time of start-up, the amount of pressure of the pressure roller 31 is reduced. When the fixing member 28 reaches a predetermined temperature, the amount of pressure is returned to the normal state. By reducing the size of the nip at the time of start-up, heat loss to the pressure roller 31 may be suppressed, thus reducing the start-up time period. During the waiting time, the pressure is reduced such that degradation caused by contact friction between the fixing member 28 and the pressure roller 31 may be reduced. While this example is not effective compared to the above-described example of positioning the pressure roller 31 away from the fixing member 28, a distance or drive power it takes for the pressure roller 31 to move from the fixing member 28 may be made smaller. Accordingly, a low-cost mechanism, such as a low torque motor, may be used to achieve the objectives of the present invention.

FIG. 11 illustrates other example embodiments of the present invention. The fixing member is implemented by a thin belt 128 provided with a releasing layer on its surface. After heating the belt 128 by the coil 56, fixing is performed at the nip. On the inner side of the fixing belt 128, a ferrite roller 129 for increasing heating efficiency of the fixing belt, and an elastic roller 127 facing the pressure roller 31 via the fixing member 128 that forms the nip, are provided. With this structure, if the fixing belt 128 is heated while the fixing member 128 is not rotated, the fixing belt 128 quickly reaches a high temperature. For this reason, the fixing belt 128 needs to be rotated when being heated. By positing away from the pressure roller 31 or reducing pressure generated by the pressure roller 31 during the start-up time or waiting time, the start-up time may be reduced without causing heat loss to the pressure roller 131, thus preventing degradation of the surface of the fixing belt 128 that may be caused due to the rotation during the waiting time.

Furthermore, any one of the image fixing operations mentioned above may be embodied in the forms of a computer program. In such a case, the computer program is preferably stored in a storage device readable to the CPU of the controller. The storage device includes any kind of memory, such as a built-in memory installed inside an image forming apparatus or a removable memory separable from the image forming apparatus. Alternatively, the computer program may downloaded via a network to be stored in the storage device.

What is claimed is:

1. A fixing device that fixes an unfixed image formed on a recording medium at a fixing nip, the fixing device comprising:

a fixing belt which is a heating member that rotates around an axis that is stationary relative to a position of the nip;

a pressure rotator configured to form the fixing nip with the fixing belt;

an induction heating coil located outside the fixing belt, the induction heating coil being configured to heat the fixing belt;

a pressure rotator separating mechanism configured to move the pressure rotator away from the fixing belt; and a controller configured to control a start-up state of the fixing device during which the fixing belt is rotated while being heated by the induction heating coil, the start-up state being completed by performing two step rotation modes, the modes including a first start-up mode in which, while the pressure rotator is positioned away from the fixing belt by the pressure rotator separating mechanism, the controller controls the fixing belt to rotate the fixing belt while the fixing belt is heated until the fixing belt reaches a predetermined temperature or the fixing belt is rotated while being heated for a predetermined time period, and a second start-up mode, performed after the first start-up mode, in which the controller controls the pressure rotator separating mechanism to move the pressure rotator towards the fixing belt such that the fixing belt is heated and rotated while the pressure rotator is in contact with the fixing belt, wherein the start-up state is performed without advancing a recording medium toward the fixing nip, and wherein, after the second start-up mode is completed, the controller sends a control signal to start an image fixing operation such that the recording medium advances towards the fixing nip.

2. The fixing device of claim 1, wherein the pressure rotator is brought into contact with the fixing belt when a temperature of the fixing belt reaches the predetermined temperature.

3. The fixing device of claim 1, further comprising:

a ferrite roller provided on the inner side of the fixing belt.

4. The fixing device of claim 1, further comprising:

a temperature sensor configured to detect a surface temperature of the fixing belt, wherein the temperature sensor is provided between the induction heating coil and the fixing nip.

5. The fixing device of claim 1, wherein the fixing belt includes a heat emitting layer.

6. The fixing device of claim 5, wherein the heat emitting layer includes a metal.

7. The fixing device of claim 1, wherein the heating member is disposed between a roller around which the heating member is wrapped and the induction heating coil.

8. An image forming apparatus comprising a fixing device that fixes an unfixed image formed on a recording medium at a fixing nip, the fixing device including:

a fixing belt which is a heating member that rotates around an axis that is stationary relative to a position of the nip;

a pressure rotator configured to form the fixing nip with the fixing belt;

an induction heating coil located outside the fixing belt, the induction heating coil being configured to heat the fixing belt;

a pressure rotator separating mechanism configured to move the pressure rotator away from the fixing belt; and a controller configured to control a start-up state of the fixing device during which the fixing belt is rotated while being heated by the induction heating coil, the start-up state being completed by performing two step rotation modes, the modes including a first start-up mode in which, while the pressure rotator is positioned away from the fixing belt by the pressure rotator separating mechanism, the controller controls the fixing belt to rotate the fixing belt while the fixing belt is heated until the fixing belt reaches a predetermined temperature or the fixing belt is rotated while being heated for a predetermined time period, and a second start-up mode, performed after the first start-up mode, in which the controller controls the pressure rotator separating mechanism to move the pressure rotator towards the fixing belt such that the fixing belt is heated and rotated while the pressure rotator is in contact with the fixing belt, wherein the start-up state is performed without advancing a recording medium toward the fixing nip, and wherein after the second start-up mode is completed, the controller sends a control signal to start an image fixing operation such that the recording medium advances towards the fixing nip.

9. The image forming apparatus of claim 8, wherein the heating member is disposed between a roller around which the heating member is wrapped and the induction heating coil.

10. A method of operating a fixing device, the method comprising:

providing a fixing belt that is heating member that rotates around an axis;

providing a pressure rotator separating mechanism that moves a pressure rotator, which forms a nip with the fixing belt, away from the fixing belt;

rotating the fixing belt around the axis during a first start-up mode of a start-up state and heating the fixing belt via an induction heater disposed outside of the fixing belt while the pressure rotator is in a position separated from the fixing belt until the fixing belt reaches a predetermined temperature or for a predetermined time, and the axis remains stationary with respect to a position of the nip;

after the rotating the fixing belt during the first start-up mode, rotating the fixing belt around the axis during a second start-up mode of the start-up state and heating the fixing belt via an induction heater disposed outside of the fixing belt while the pressure rotator is in a position in contact with the fixing belt; and after the rotating the fixing belt during the second start-up mode, starting an image forming operation such that a recording medium advances towards the nip, wherein rotating during the first start-up mode and the second start-up mode of the start-up state is performed without advancing the recording medium toward the fixing nip.

* * * * *